US008950016B2

(12) United States Patent
Depplito

(10) Patent No.: US 8,950,016 B2
(45) Date of Patent: Feb. 10, 2015

(54) ACCESSORY-RETAINING NECK SCARF

(71) Applicant: Karen A. Depplito, Northport, NY (US)

(72) Inventor: Karen A. Depplito, Northport, NY (US)

( * ) Notice: Subject to any disclaimer, the term of this patent is extended or adjusted under 35 U.S.C. 154(b) by 213 days.

(21) Appl. No.: 13/676,681

(22) Filed: Nov. 14, 2012

(65) Prior Publication Data

US 2013/0117907 A1 May 16, 2013

Related U.S. Application Data

(60) Provisional application No. 61/592,580, filed on Jan. 30, 2012, provisional application No. 61/559,685, filed on Nov. 14, 2011.

(51) Int. Cl.
*A41D 23/00* (2006.01)
*A42B 5/00* (2006.01)

(52) U.S. Cl.
CPC .. *A42B 5/00* (2013.01); *A41D 23/00* (2013.01)
USPC ..... 2/207; 2/244; 63/33

(58) Field of Classification Search
CPC ..... A41D 23/00
USPC ..... 63/1.11, 33; 2/244, 207; D2/500
See application file for complete search history.

(56) References Cited

U.S. PATENT DOCUMENTS

D136,097 S * 8/1943 Goodman ..... D2/500
5,016,284 A * 5/1991 Brown ..... 2/69
7,818,819 B2 * 10/2010 Chiang ..... 2/206

* cited by examiner

*Primary Examiner* — Jack W Lavinder
(74) *Attorney, Agent, or Firm* — Hoffmann & Baron, LLP

(57) ABSTRACT

An accessory-retaining neck scarf that includes: a scarf, one or more reinforced apertures and an accessory strand. The scarf is formed as an elongate web for wrapping around a wearer and has a length between first and second ends and a width between first and second sides. The reinforced apertures form openings from one exterior surface of the scarf to the opposing exterior surface. The accessory strand extends along at least a portion of the lengthwise extent of the scarf and weaves continuously through one or more of the apertures.

9 Claims, 21 Drawing Sheets

ACCESSORY-RETAINING NECK SCARF

This application claims priority from provisional application Ser. No. 61/559,685, filed on Nov. 14, 2011, and provisional application Ser. No. 61/592,580, filed on Jan. 30, 2012, both of which are incorporated herein in their entirety.

TECHNICAL FIELD

The present invention relates to accessory-retaining neck scarfs. In particular, the present invention relates to neck-scarfs with accessories that pass though and can be secured in apertures in the neck-scarfs.

BACKGROUND

In the apparel industry, and particularly neckwear, it is common to wear scarves, jewelry or other elements that adorn or cover a user's neck and upper torso. However, combining these elements can often be difficult as the various pieces may not stay in place as desired by a user. Moreover, in the prior art, the accessories were often combined with scarfs using clasps and pins that passed through and damaged the scarf when attached. Thus, there are natural deterrents to integrating multiple pieces of adornment, particularly when they won't stay in position relative to one another without constant adjustment by the user. Also, when it comes to articles worn particularly about a user's neck, comfort must always be maintained. Accordingly, it would be desirable to provide an accessory-retaining neck scarf that enables accessories to be quickly and easily combined with the scarf in a variety of different configurations and overcomes the various shortcomings of the prior art.

SUMMARY OF THE INVENTION

In accordance with the present invention, an accessory-retaining neck scarf is provided that includes: a scarf, one or more reinforced apertures and an accessory strand. The scarf is formed as an elongate web for wrapping around a wearer and has a length between first and second ends and a width between first and second sides. The reinforced apertures form openings from one exterior surface of the scarf to an opposing exterior surface. Each of the plurality of apertures is reinforced by a grommet, an eyelet, a rivet or a material more rigid than that of the scarf. Preferably, the scarf includes at least four reinforced apertures. The plurality of apertures can be disposed along a lengthwise extent of the scarf. The accessory strand preferably extends along at least a portion of the lengthwise extent of the scarf and passes through one or more of the apertures.

In a preferred embodiment, one end of the scarf can be folded along the width to form two mutually engaging folds so that the apertures form openings that extend through the mutually engaging folds of the scarf. As used herein the term "folded along the width" refers to folding one end of the scarf in the direction of the second end. Similarly, as used herein, the term "folded along the length" refers to folding one side of the scarf in the direction of the second side.

In another embodiment, the scarf has a first fold and a second fold along the lengthwise extent so that the sides of the scarf are disposed adjacent to each other. The first and second folds have first and second top sides that are disposed opposite first and second back sides, respectively, and the first top side is disposed adjacent to the second top side so that the first and second back sides of the fold form exterior surfaces of the scarf. Each of the plurality of apertures extends through the first and second back sides of the scarf.

The accessory strand can include an ornamental feature extending away from a lengthwise center of the scarf in a widthwise direction. At least one of two opposed ends of the accessory strand includes a fastener, which is used to secure the fastener end of the strand to another portion of the accessory strand. The accessory strand can be formed by chains, ropes, belts, ribbons, sashes, scarves, belts or decorative strands adorned with jewelry.

The plurality of reinforced apertures can include a first set of mutually spaced apertures and a second set of mutually spaced apertures. The first and second sets of mutually spaced apertures are set-off from one another by a distance greater than the spacing between the apertures in the first set or the second set. Preferably, the reinforced apertures are grommets, eyelets or rivets.

In another embodiment, the accessory-retaining neck scarf includes: a scarf, one or more pleats, a plurality of reinforced apertures and one or more accessory strands. The scarf is formed as an elongate web for wrapping around a wearer and has a length between first and second ends and a width between first and second sides. The pleats are formed in the scarf and each pleat includes a fold-line of material extending across the width of the scarf. At least one of the pleats is formed by two or three layers of the scarf folded over or in an S-shaped pattern, respectively. Each reinforced aperture forms an opening from one exterior surface of the scarf to an opposing exterior surface and at least one pair of apertures is spaced laterally across the width of the scarf. At least one aperture is formed in each pleat so that the apertures extend through the three layers of the S-shaped pattern. Each accessory strand passes through one or more of the apertures.

In another embodiment, the accessory-retaining neck scarf includes: a scarf and a plurality of reinforced apertures. The scarf is formed as an elongate web for wrapping around a wearer and has a length between first and second ends and a width between first and second sides. The lengthwise folds in the scarf form four layers. First and second pleats are formed on the first and second ends by folding the ends of the scarf toward the middle and then folding the ends back so that they extend in opposing directions. Each aperture forms an opening from one exterior surface of the scarf to an opposing exterior surface and at least one aperture is formed in and extends through each pleat. Preferably, each pleat includes at least six layers of the scarf. After the scarf is placed around a wearer's neck, an accessory strand can be inserted through the reinforced apertures to connect the ends of the scarf and secure it in place.

BRIEF DESCRIPTION OF THE DRAWINGS

The accompanying drawings, which are incorporated in and constitute a part of this disclosure, illustrate embodiments of the disclosure, and together with a general description of the disclosure given above, and the detailed description of the embodiments given below, serve to explain the principles of the present disclosure.

DETAILED DESCRIPTION

Figure 1:
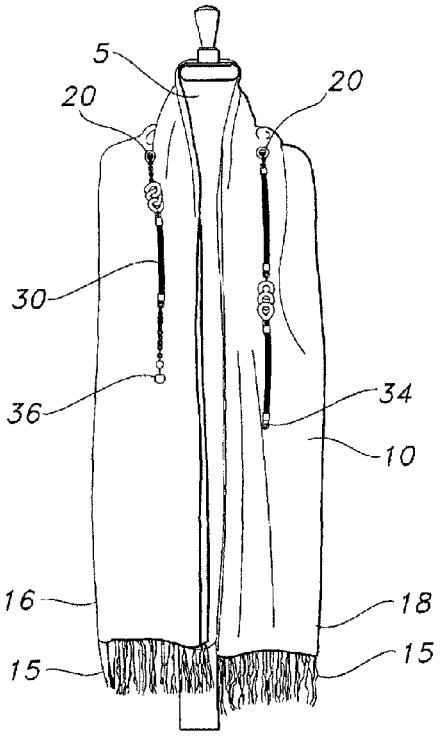
FIG. 1 is a front elevation view of an accessory-retaining neck scarf in accordance with an embodiment of the present invention.

Reference is now made to the drawings, in which like reference numerals identify identical or substantially similar parts throughout the several views.

As used herein, the term "scarf" refers to a broad band of pliable material formed as an elongate web generally worn around the user's body, particularly around the neck and over the shoulders, with either end hanging down in front of the body. A scarf, as referred to herein, can be formed from one or more layers of material. It should be understood that reference to the term scarf includes shawls, ties, garment wraps and other fabric neckwear. Also, as used herein, the scarf can be made from various materials; including silk, cashmere, wool, viscose, chiffon, polyester, pashmina, nylon, cotton, acrylic, and further textiles or materials suitable for neckwear.

As used herein, the term "aperture reinforcement member" refers to reinforcing elements used to surround and cover the inner lining of a hole extending through one or more layers of the scarf. An aperture reinforcement member as used herein can be (and the term can be used interchangeably with) a grommet, an eyelets and a rivet, which extends through one or more layers of material that form the scarf. It should be understood that such aperture reinforcement members need not be round, but can be made to virtually any desired shape, and formed of any material suitable to reinforce an aperture as desired.

As used herein, the term "accessory strand" includes chains, ropes, belts, ribbons, sashes, scarves, fabric belts and belts more generally, particularly decorative strands including permanently secured or removable jewelry. Accordingly, materials such as metals, precious metals, pearls, chains, leather, leatherette, fabric, ribbon, beads, crystal, rhinestone, diamonds, semi-precious stones, precious stones, gems, feathers, charms and costume jewelry can be incorporated thereon. Additionally, an accessory strand can include more than one individual elongate element combined or secured in some manner. Further, adjustment features can be included for changing aspects of the accessory strand itself, such as length or configuration.

FIG. 1 shows an embodiment of an accessory-retaining neck scarf 10 of the present invention. The neck scarf 10 includes a series of apertures 20 and an accessory strand 30. The scarf 10 is shown worn on a user torso form 5 to provide an impression of the scarf 10 being worn around a user's neck and draped over the shoulders and down the user's front. The scarf 10 is shown with tassels 15, but these are optional as would be fringes or other decorations at the remote ends 16, 18 of the scarf 10. These remote decorations or features can be present in preferred embodiments. Also, the accessory strand 30 is shown with its two opposed ends 16, 18 hanging loose in front of the user's body. As shown, a series of mutually spaced apertures 20 are formed in the scarf 10. The apertures 20 can be of any size, type or shape and can include reinforcement elements to prevent damage to the scarf 10 or the accessory strand 30.

Figure 2:
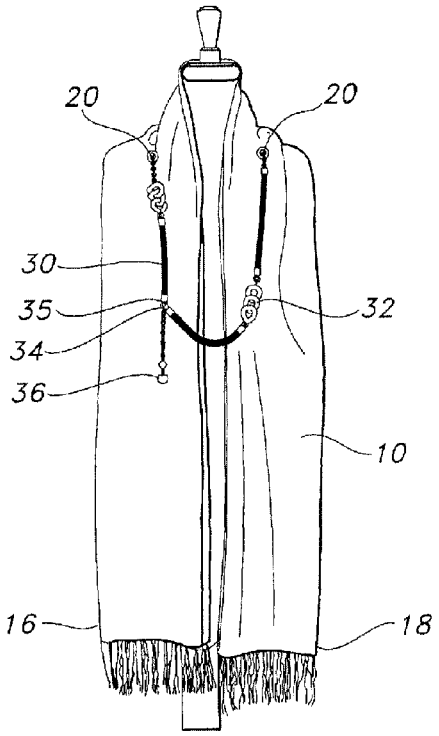
FIG. 2 shows the accessory-retaining neck scarf of FIG. 1 with the accessory strand fastener secured to a second remote portion of the accessory strand.

FIG. 2 shows the neck scarf of FIG. 1 with the fastener end 34 of the accessory strand 30 secured to a portion 35 near the other end of the accessory strand 30. It should be understood that the fastener end 34 could have been secured closer to the opposite remote end 36 or at various other points along the accessory strand 30. Also, as a further alternative, one or more ends of the accessory strand 30 can have a fastener for clipping onto a desired location of the scarf 10 itself, rather than clipping onto the another point on the accessory strand 30. The accessory strand 30 shown includes decorative elements 32 which can be incorporated almost anywhere along the length of the strand 30.

Figure 3:
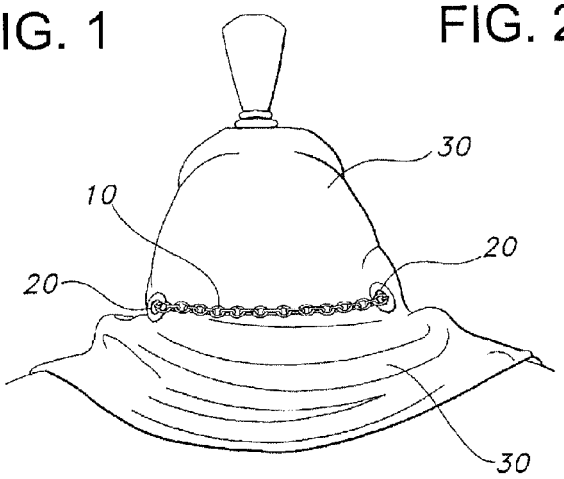
FIG. 3 is a rear elevation view of a portion visible from a wearer's back of the accessory-retaining neck scarf of FIG. 1.

FIGS. 1 and 2 show two of the series of spaced apertures 20 included on the neck scarf 10. This embodiment includes four such apertures 20, two more of which are shown in FIG. 3, visible from the back of the wearer. The accessory strand 30, which is shown as a chain in this embodiment, is woven from one side of the scarf 10 to the other, through the series of apertures 20. In this way, a central portion of the chain is exposed on the back of the user's neck as shown in FIG. 3. The scarf 10 could optionally be folded down over the apertures 20 and the accessory strand 30 to cover them. Additionally, two end portions 34, 36 of the accessory strand 30 hang down the front torso of the user. In this way, the series of spaced apertures 20 provide a means of aligning the accessory strand 30 on the scarf 10. Also, the accessory strand 30 is adjustable relative to the scarf 10, since it can be pulled-through the apertures 20 to change its relative position, while still remaining properly aligned relative to a central longitudinal axis of the scarf 10. By pulling the accessory strand 30, for example at either end 34, 36, the position of the accessory strand 30 can be adjusted relative to the scarf 10. Also, while the accessory strand 30 position is adjustable, the woven configuration provides a frictional holding force that restricts movement, so the pieces don't move out-of-place on their own from normal body movements.

It should be understood that the neck scarf 10 can be made from any type of fabric, such as silk, cashmere, wool, viscose, chiffon, polyester, pashmina, nylon, cotton, acrylic and other known materials. The neck scarf 10 is not limited to be worn by a female, but can be worn by men and altered in its style as desired. Additionally, the scarf 10 can be embellished with crystals, rhinestones, diamonds, precious stones, semi-precious stones, gems, silver, gold, metals, plastic and other ornamentation. By using aperture reinforcement members 25 in the apertures 20, the scarf 10 material is reinforced and protected from excess wear as a result of the accessory strand 30 being moved back and forth. The apertures 20 enable the scarf 10 to retain accessories such as the accessory strand 30. In this way, a user can wear what is normally two separate fashion accessories together and they are held in place. In one embodiment, the design allows a user to replace or change the accessory strand 30 in order to adapt the appearance of the scarf 10 and the accessories incorporated therewith. Also, the aperture reinforcement members 25 protect the scarf 10 from tearing, while also providing a lower friction surface for adjusting the accessory strand 30. In spite of the lower friction provided by the reinforcement members 25, the woven configuration of the accessory strand 30 still generally provides enough frictional engagement to hold both pieces in place relative to one another.

The accessory strand 30 while shown as a chain could alternatively be another elongate strand such as a strap, band, rope, ribbon, sash, scarf, fabric belt or other belt and could be varied of various sizes and thicknesses. Also, the two opposed ends of the strand 34, 36 can include fasteners or clasps. As a further alternative, such fasteners or clasps could be disposed more centrally in order to secure two segments of the accessory strand 30 and leave segments of the remote ends dangling therefrom.

Figure 4:
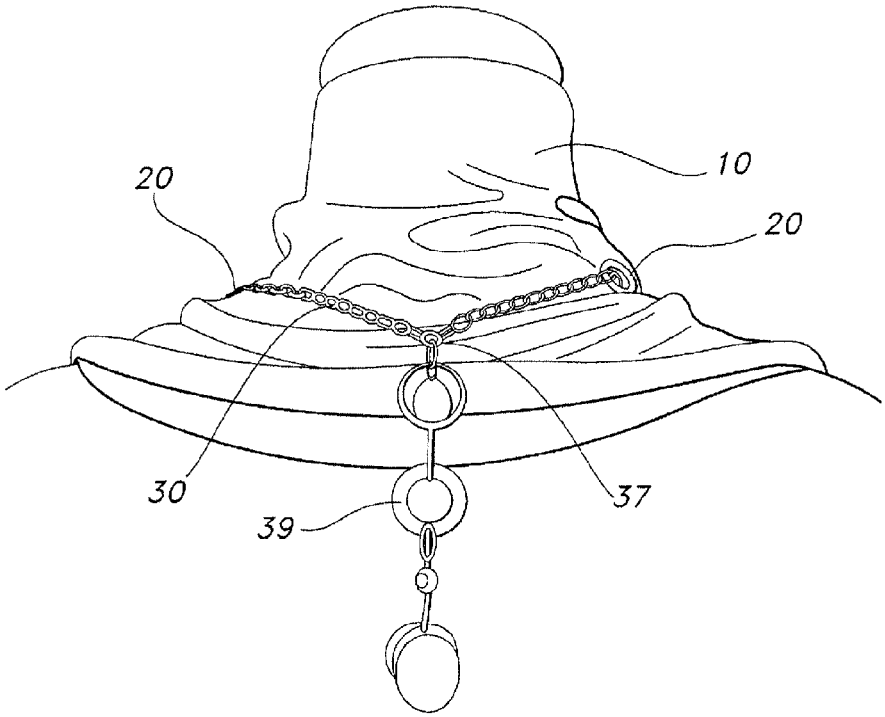
FIG. 4 shows a rear elevation view of an alternative design of an accessory strand in accordance with an embodiment of the present invention.

FIG. 4 shows an alternative back accessory 39, which is attached to the accessory strand 30 by a fastener 37 and generally hangs down a user's back. Various such ornamental accessories can be hung from this portion of the accessory strand 30. Also, the position of the back accessory 39 can even be adjusted if the wearer pulls the accessory strand 30 at its center (the part normally on the back of the wearer's neck), it will hang down the user's back further. Then pulling either end 34, 36 will draw the central portion of the accessory strand 30 back toward the wearer's head so that it does not dangle as low on the wearer's back.

Figure 5:
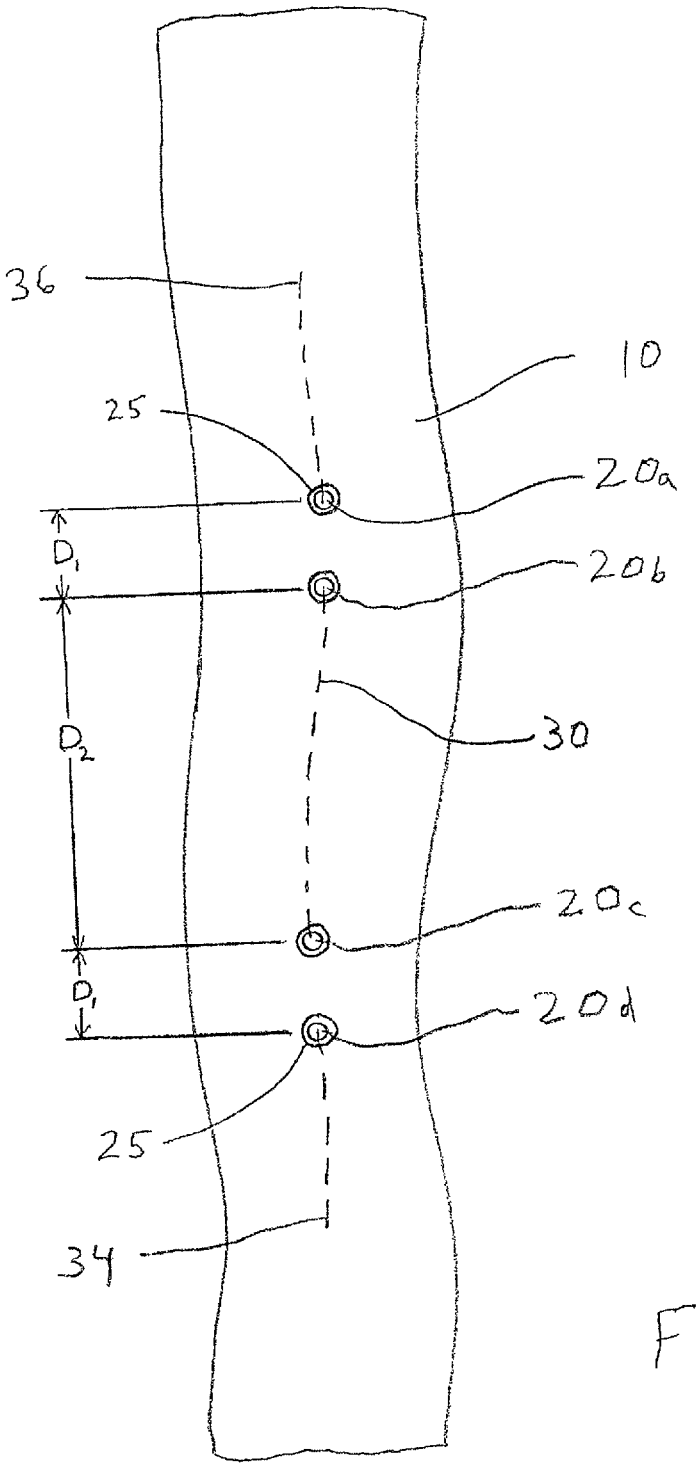
FIG. 5 is a top view of an accessory-retaining neck scarf in accordance with an embodiment of the present invention.
Figure 6:
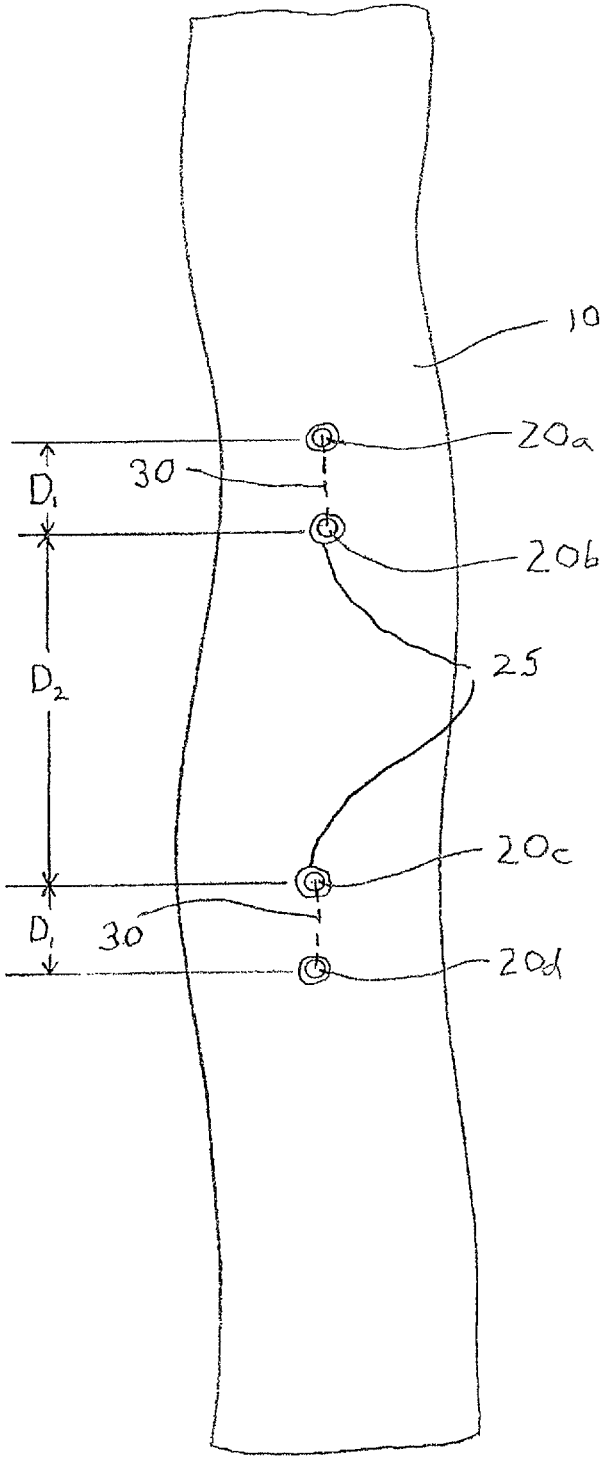
FIG. 6 shows a bottom view of the accessory-retaining neck scarf of FIG. 5.
Figure 7:
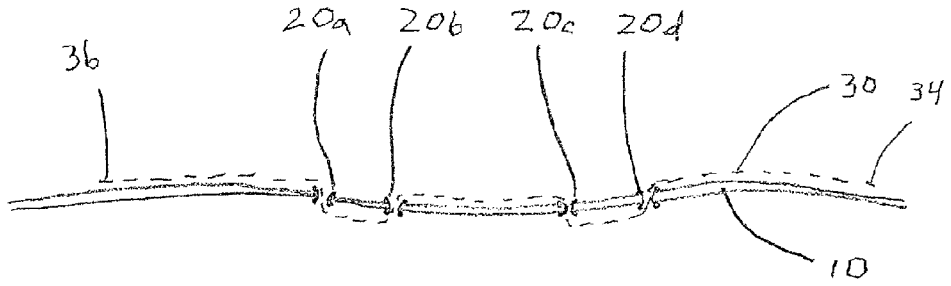
FIG. 7 shows a cross-sectional side view of the accessory-retaining neck scarf of FIG. 5.

FIGS. 5-7 show schematic views of a neck scarf 10 in accordance with one of the embodiments and how the accessory strand 30 is woven through the series of apertures 20. In these figures, the dotted line represents the accessory strand 30 as visible from the side shown in the respective drawings. The accessory strand 30 can be any type as further described above. As shown, the strand 30 can be woven through a first hole 20*a* toward the back side of the scarf 10 and then return through the second hole 20*b* passing along the front side of the scarf 10, then return through the third aperture 20*c* and back again to the back side of the scarf 10 and then out again through the fourth aperture 20*d*. In this way, both remote ends 34, 36 of the strand 30 are on the same side of the scarf 10. Also, as particularly shown in FIG. 6, only small extents of the elongated strand 30 end up on the side of the scarf 10 that faces the user's body, thus minimizing any abrasive contact with the user, which could possibly be felt on their skin or through their clothes. In this regard, the scarf 10 could alternatively be folded over on itself, along a lengthwise extent so that the elongate strand 30 is sandwiched between two folds of the scarf 10, thereby eliminating contact of the accessory strand 30 with the user's skin.

Further, the spaced apertures 20 can include a first set of mutually spaced apertures 20*a,b* (disposed on one half of the scarf 10) and a second set of mutually spaced apertures 20*c,d* (disposed on the other half of the scarf 10). The sets of apertures 20*a,b* and 20*c,d* in each of the individual first and second sets are spaced apart from one another by a first distance $D_1$. Also, the sets of apertures 20*a,b* and 20*c,d* are spaced apart from one another by a second distance $D_2$. In the embodiment shown, the first distance $D_1$ is smaller than the second distance $D_2$. However, it should be noted that, if desired, these distances can be different. In fact, the first distance $D_1$ can be greater than the second distance $D_2$.

Figure 8:
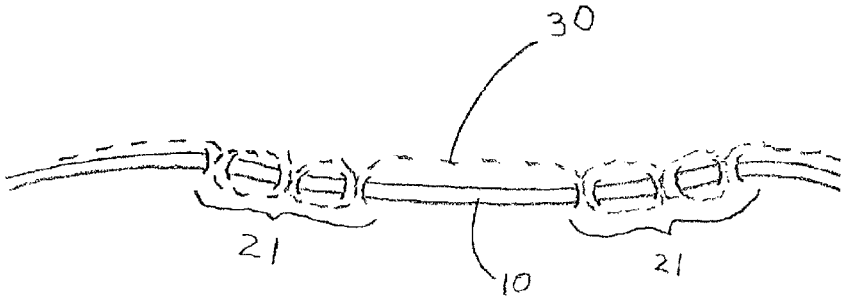
FIG. 8 shows a cross-sectional side view of an alternative embodiment of an accessory-retaining neck scarf.

The spacing of the apertures 20*a-d* is further shown in FIGS. 7 and 8. In particular, the series of reinforced apertures includes a first set of mutually spaced apertures 20*a,b* and a second set of mutually spaced apertures 20*c,d*. The first and second sets of mutually spaced apertures 20*a,b* and 20*c,d* are set-off from one another by a distance (between apertures 20*b* and 20*c*) greater than the spacing between apertures from either set (between apertures 20*a* and 20*b* or between apertures 20*c* and 20*d*).

FIG. 8 shows an alternative cross-sectional side view of the scarf 10 including additional reinforced apertures 21. As the additional apertures 21 include an odd number of apertures 21 on each half of the scarf 10, the accessory strand 30 is then looped around through the apertures 21 in order to leave a greater extent of the accessory strand 30 on one side of the neck scarf 10. The looped portions can be formed as separate extents, with the other strand portions being removeably or fixedly attached thereto.

Figure 9:
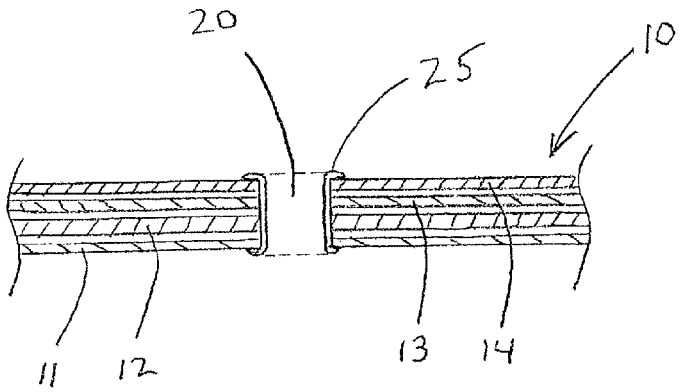
FIG. 9 shows a cross-sectional release view of an aperture reinforcement member in a scarf in accordance with an embodiment of the present invention.

FIG. 9 shows a close-up cross-sectional relief view of a reinforcement member 25, in the form of a grommet, inserted in an aperture 20 of a multi-layered scarf 10. In this particular embodiment, the scarf 10 is formed by longitudinal folds of material so that the grommet 25 passes through multiple layers 11, 12, 13, 14 of material. By using the grommet 25, the arrangement of the apertures 20 the layers of the scarf 10 stays in alignment, which maintains an opening passing from one side of the scarf 10 to the other.

Figure 10A:
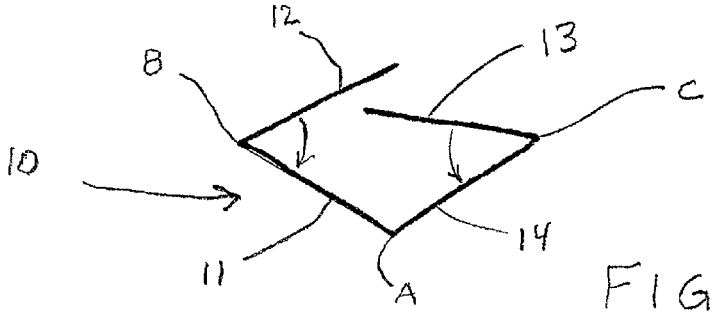
FIG. 10A shows a scarf being folded in accordance with an embodiment of the present invention.
Figure 10B:
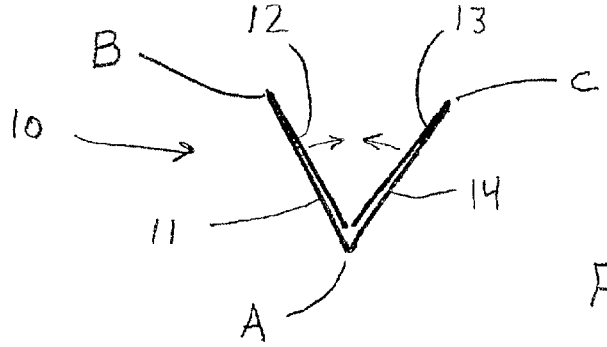
FIG. 10B shows the scarf of FIG. 10A being further folded in accordance with an embodiment of the present invention.

FIGS. 10A and 10B show an end view of the scarf 10 being folded in a way that achieves the four layered arrangement shown in FIG. 9. The scarf 10 is folded lengthwise so that a first half of the width of the scarf 10 is folded in two. Thus, considering the first half of the scarf 10 to have two first extents 11, 12, such that segment 12 is folded over onto segment 11 at fold line B (fold line B extending along the length of the scarf 10—i.e., into the page in the orientation shown in FIGS. 10A and 10B). In this way, an outer lengthwise quarter 12 of the scarf 10 is folded toward the center. Similarly, the other half of the width includes a second extent 13, 14 which is folded at a second fold line C (although the fold lines are shown as a point, on this end view it should be understood that the folds runs along the lengthwise extent of the scarf 10). Similarly, the other outer lengthwise quarter 13 of the scarf 10 is folded toward the center. In this way, one portion of the extent 13 is folded over onto the other portion of the extent 14. Once those two portions of the extent 13, 14 are folded over onto the other portions of the scarf 10, then the two halves are once again folded along their lengthwise extent along line A as shown in FIG. 10B. This folds the two halves onto each other. Once completely folded together, the apertures 20 can either be aligned or formed therein and then a reinforcement member 25 inserted to maintain them.

Figure 11:
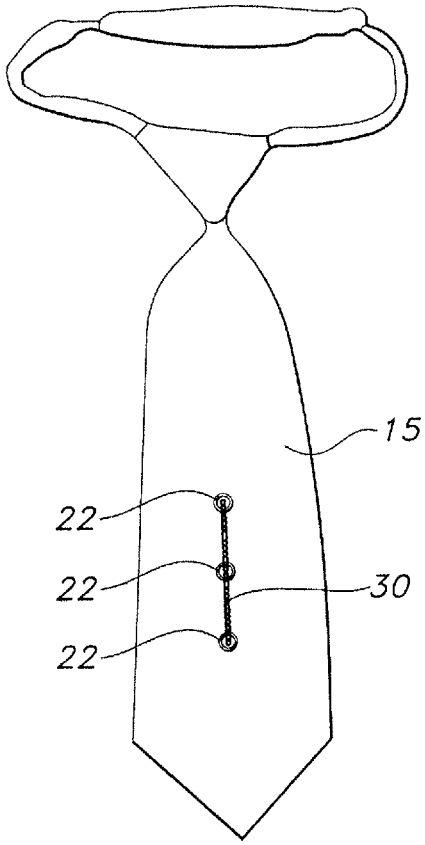
FIG. 11 shows a neck tie embodying aspects of the present invention.

FIG. 11 shows a further alternative embodiment wherein the scarf is formed as a necktie 15 and the series of apertures 22 are used to join the larger front portion of the tie 15 with the traditionally hidden smaller opposed end of the tie behind. After one or more of the apertures 22 on the larger portion of the tie 15 are lined up with one or more of the apertures 22 on the smaller portion of the tie 15, the accessory strand 30 can be used to align the two portions of the tie 15, thus keeping them together for the user.

Figure 12:
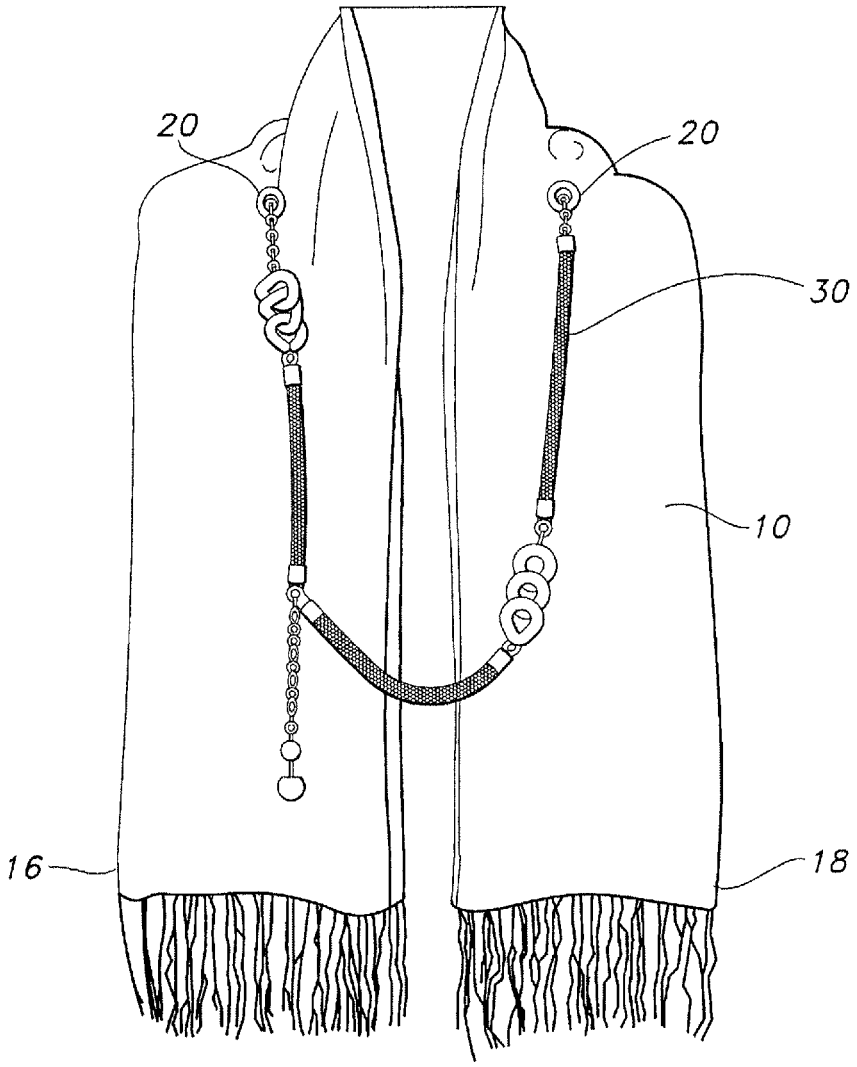
FIG. 12 shows a front elevation view of an accessory-retaining neck scarf as configured when worn by a user showing the new design.
Figure 13:
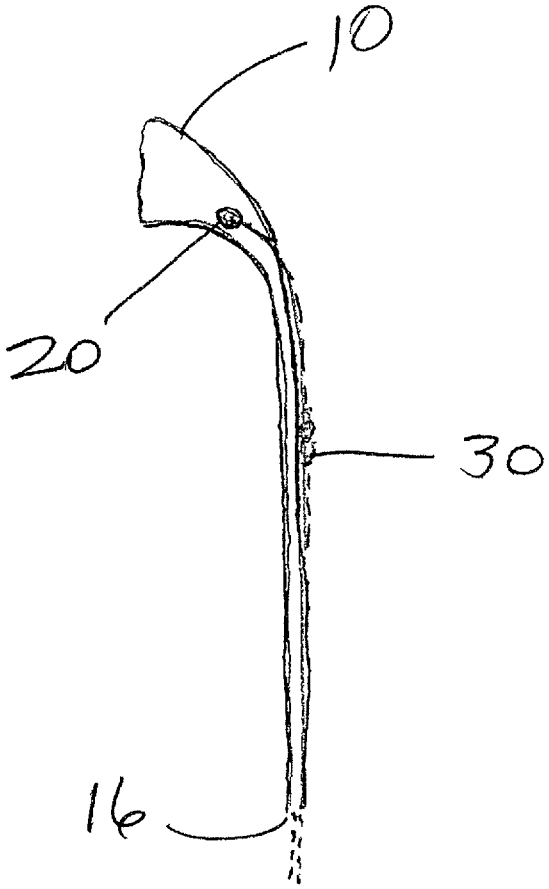
FIG. 13 shows a side view of the accessory-retaining neck scarf of FIG. 12.

FIG. 12 shows a front view of the scarf 10 with the accessory strand shown as a chain 30 woven through the apertures 20 therein. The ends 16, 18 of the scarf 10 are tasseled. One skilled in the art will appreciate that the length and design of accessory strand 30 can be changed to provide a variety of different configurations of the scarf 10. FIG. 13 shows the side view of the accessory-retaining neck scarf 10 of FIG. 12.

Figure 14:
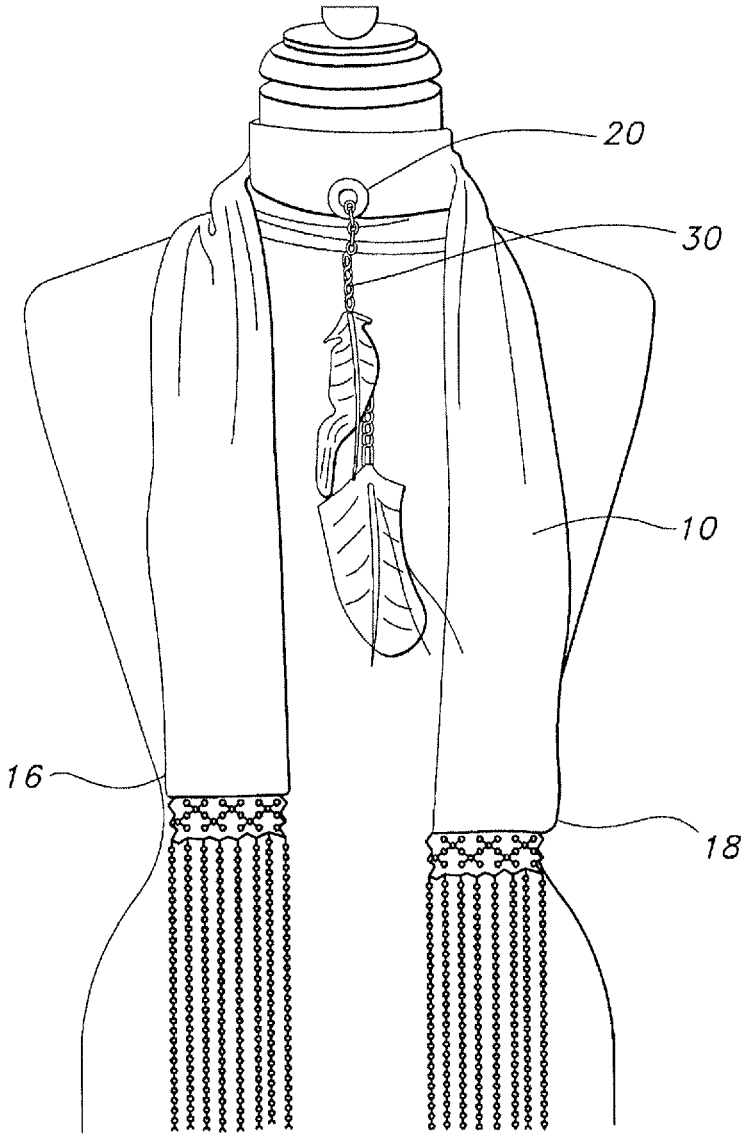
FIG. 14 shows an embodiment of the accessory-retaining neck scarf with a through hole located midway between the two ends.

FIG. 14 shows the scarf 10 worn around a user's neck with a single aperture 20 located at the user's throat with the accessory strand 30 extending downwardly. The opposing ends 16, 18 of the scarf 10 have a plurality of rows of decorative beads that hang below the user's waist.

Figure 16:
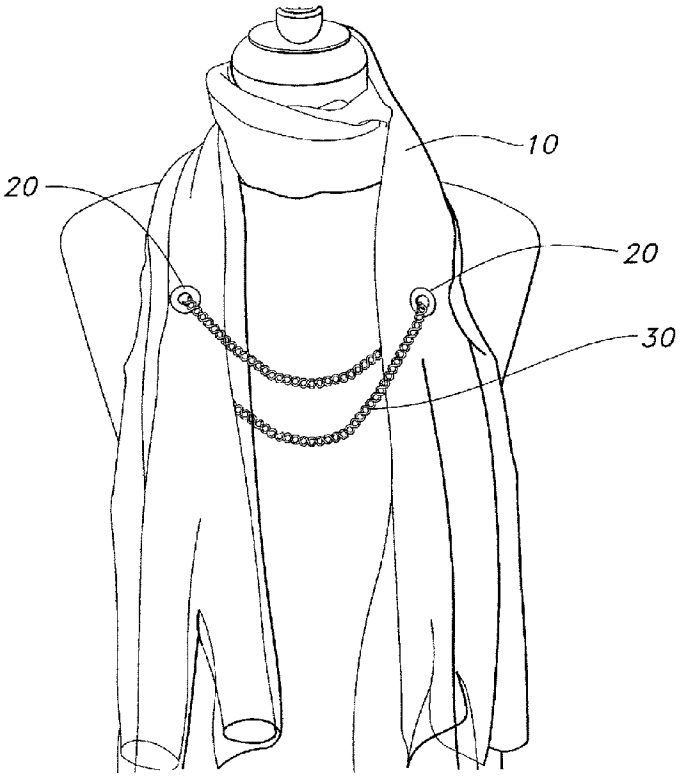
FIG. 16 shows an embodiment that includes two horizontally disposed apertures in the accessory-retaining neck scarf.
Figure 15:
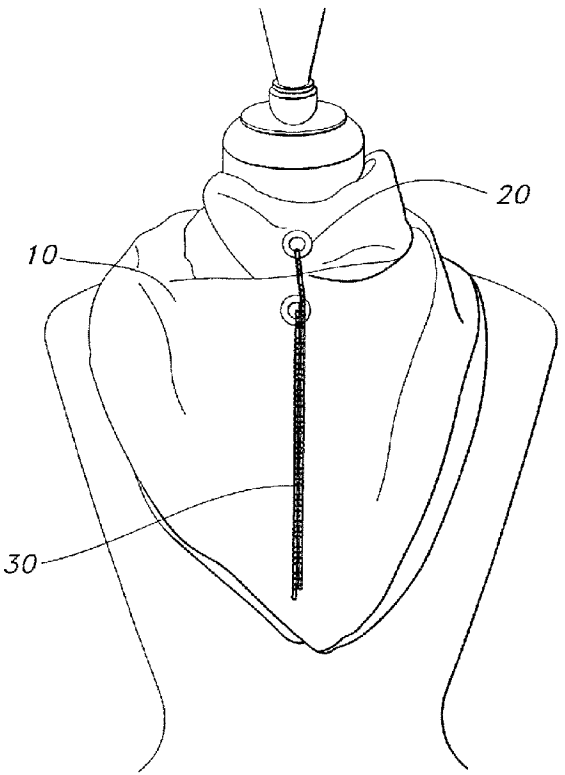
FIG. 15 shows an embodiment that includes two vertically disposed apertures in the accessory-retaining neck scarf.

FIGS. 15 and 16 show additional embodiments of the accessory-retaining neck scarf 10 as described herein. In particular, these embodiments illustrate a scarf 10 having two apertures 20 for holding an accessory strand 30. Depending on how the scarf 10 is worn, the two apertures 20 can be made to align vertically or horizontally, as shown in FIGS. 15 and 16, respectively.

Figure 17:
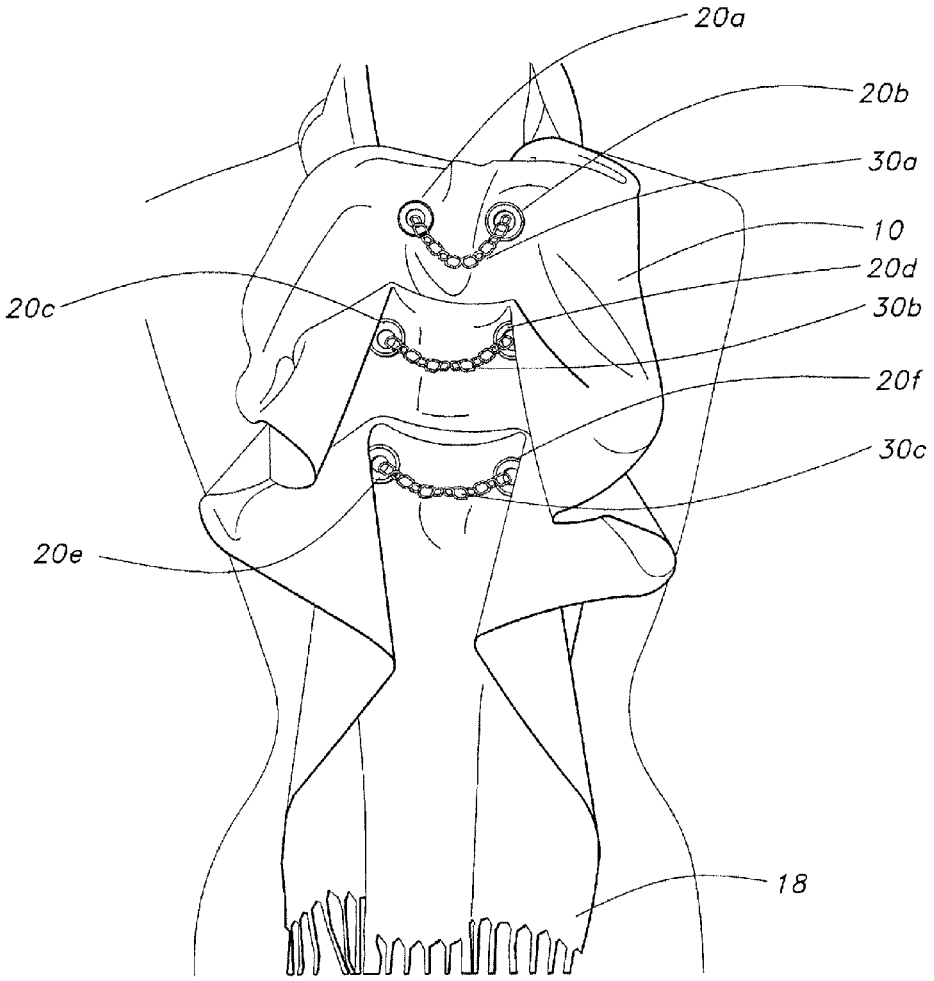
FIG. 17 shows a front elevation view of an embodiment of the accessory-retaining neck scarf with three pairs of through holes.

FIG. 17 shows an additional embodiment of the accessory-retaining neck scarf 10 as described herein. In particular, this embodiment illustrates a scarf 10 having three pairs of apertures 20*a,b*, 20*c,d* and 20*e,f* for holding a separate accessory strand 30*a-c*, respectively. This embodiment provides a wide scarf 10 profile on the wearer, as a result of the configuration of the aperture reinforcement members in the paired apertures 20*a,b*, 20*c,d* and 20*e,f*, as well as the accessory strands 30*a-c* therein. In this embodiment, once assembled and worn on a wearer as shown, one end (not shown) of the scarf 10 is substantially hidden behind the opposing end 18, somewhat like a contemporary necktie. In order to complete the donning of the scarf 10 shown in FIG. 17, the scarf 10 should be placed around the back of a wearer's neck, with the two ends 16, 18 of the scarf 10 hanging down in front of the wearer. Preferably, the two ends 16, 18 hang evenly. The scarf 10 half that includes the paired rows of apertures 20*a,b*, 20*c,d* and 20*e* gets folded over the plain half. Then, the paired apertures 20*a,b*, 20*c,d* and 20*e* half of the scarf 10 gets folded under the other half toward the wearer's chin and pulled through so that it eventually hangs down the middle of the wearer's front. Thereafter, one or more accessory strands 30*a-c* can be threaded through the mutual pairs of apertures 20*a,b*, 20*c,d* and 20*e*.

Figure 18:
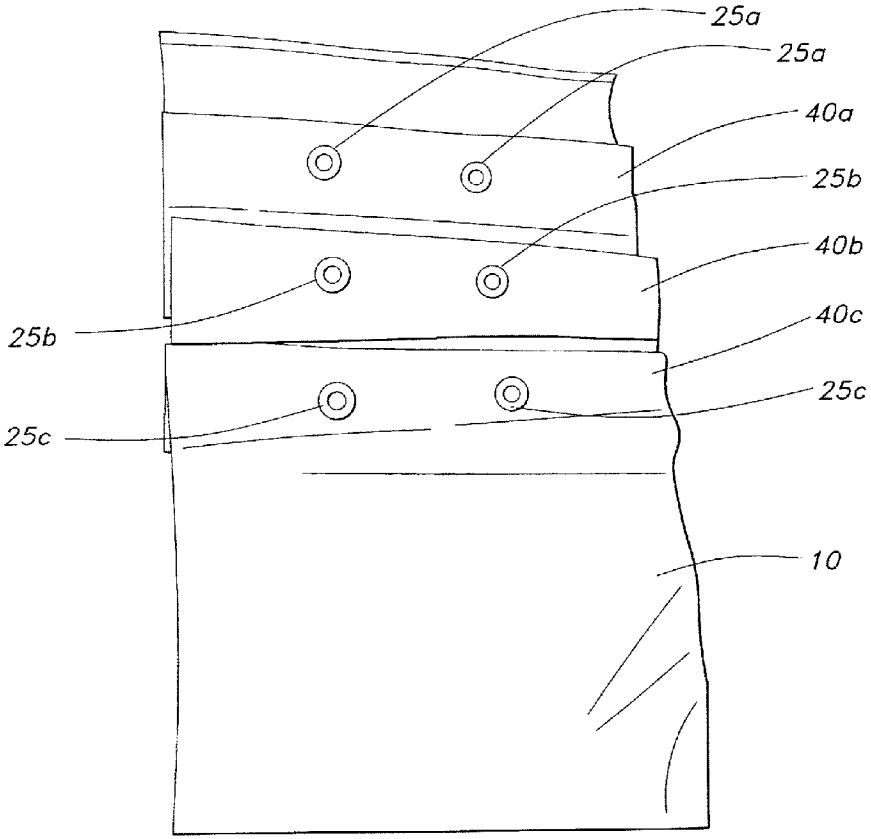
FIG. 18 shows an embodiment of the accessory-retaining neck scarf with three pairs of through holes in three pleated sections.
Figure 19:
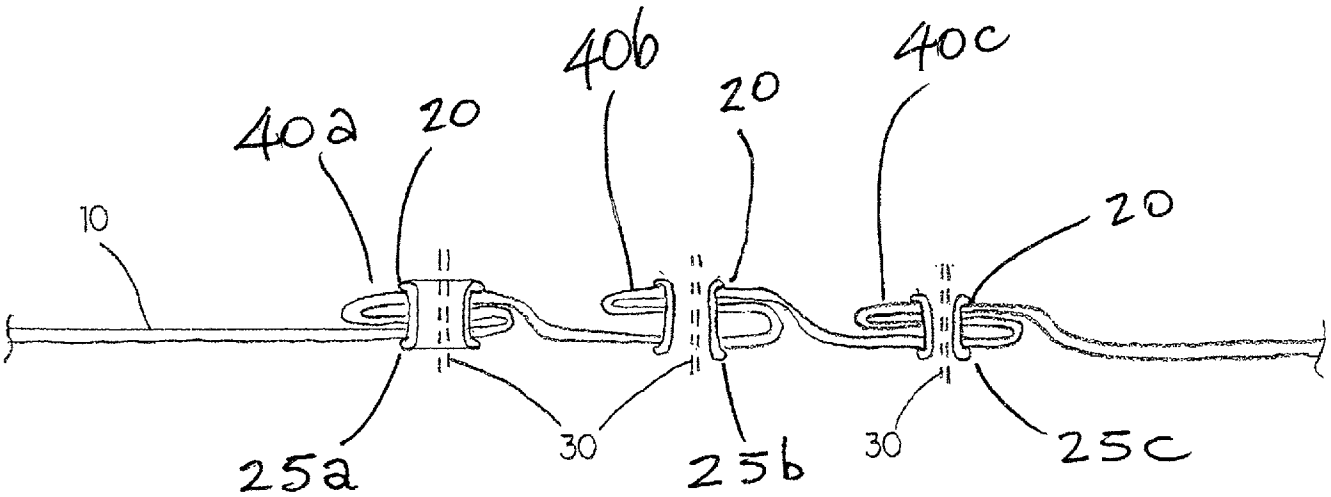
FIG. 19 shows a cross-sectional, side view of the pleated sections with grommets of FIG. 18.

FIG. 18 shows an embodiment wherein the accessory-retaining neck scarf 10 is folded over to form three pleats 40*a-c* with three pairs of grommets 25*a-c* maintaining the pleats 40*a-c* and providing through holes. A cross-sectional side view of the scarf 10 in FIG. 18 is shown in FIG. 19 and illustrates how the folds of fabric lay on top of one another and are folded in an S-shaped pattern to form the pleats 40*a-c*. Apertures 20 are then formed through the three layers of fabric and the grommets 25 pass through the three layers. At this stage, the scarf 10 can be further accessorized by adding accessory strands 30 or sold as-is for a purchaser to accessorize as desired, for example by threading chains, scarves or the like through the grommets 25*a-c* as discussed above.

Figure 20:
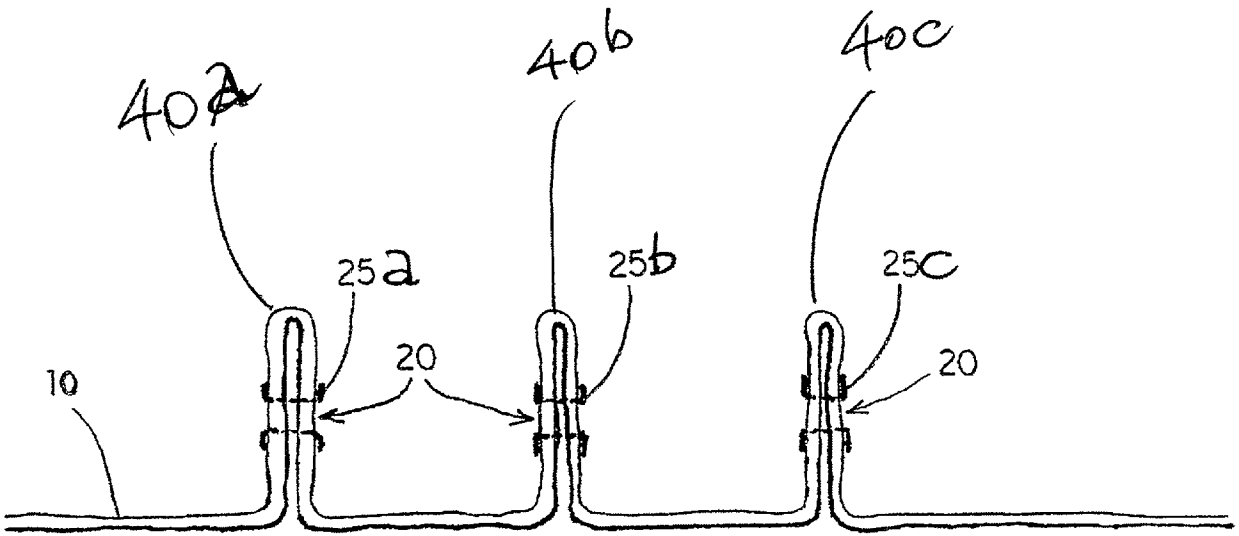
FIG. 20 shows a close-up cross-sectional, side view of alternative embodiment having pleated sections with grommets.

FIG. 20 shows an alternative embodiment of the accessory-retaining neck scarf 10 in which an aperture 20 is formed through two layers of fabric. The pleats 40*a-c* hang downwardly onto the scarf 10, unless held up by alternative means. Aperture reinforcement members 25*a-c*, preferably grommets, are then installed through the two layers of overlapping material. Once the fabric is removed from the area inside the grommets 25*a-c*, apertures 20 are formed, which pass from one side of the scarf 10 to the other.

Figure 21:
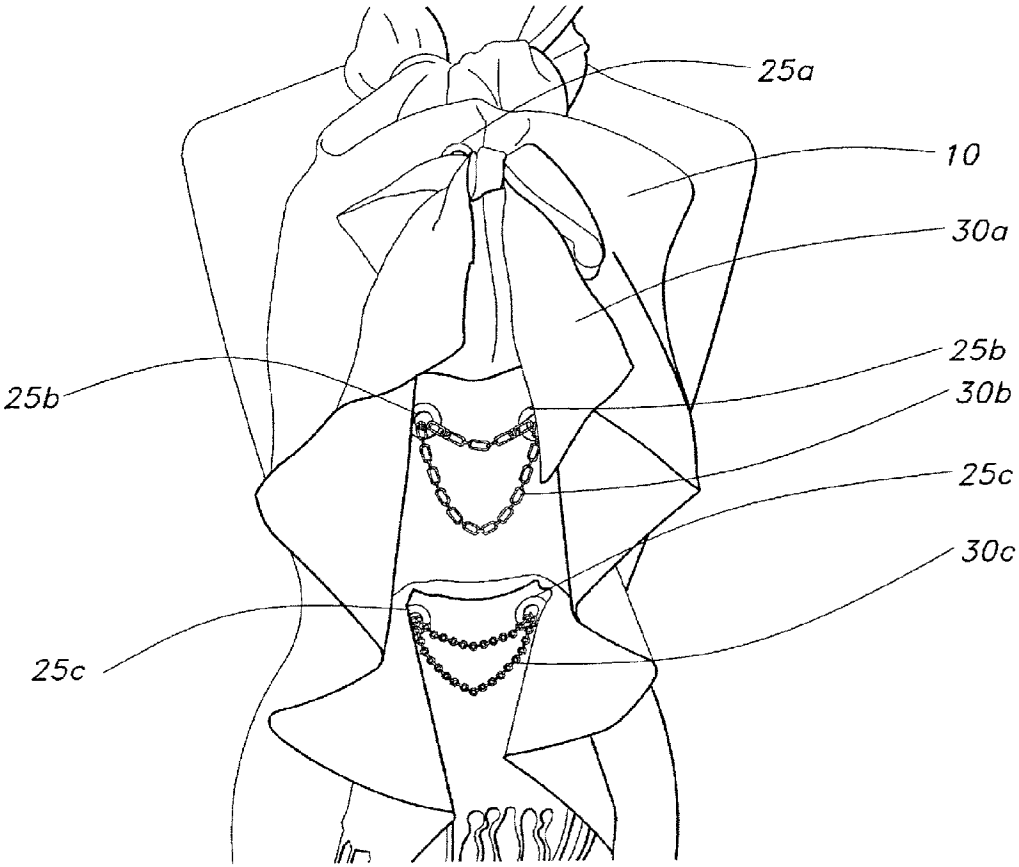
FIG. 21 shows an alternative embodiment of the accessory-retaining neck scarf of FIG. 17.

FIG. 21 shows a pleated embodiment of the accessory-retaining neck scarf 10 accessorized by a fabric bow 30*a* and two chains 30*b,c*. It should be noted how this embodiment does not hold the scarf 10 as wide and flat across a wearer's front as the previous embodiments. The three pairs of grommets 25*a-c* and the individual accessory strands 30*a-c* help maintain the wide flat look on a wearer.

Figure 22:
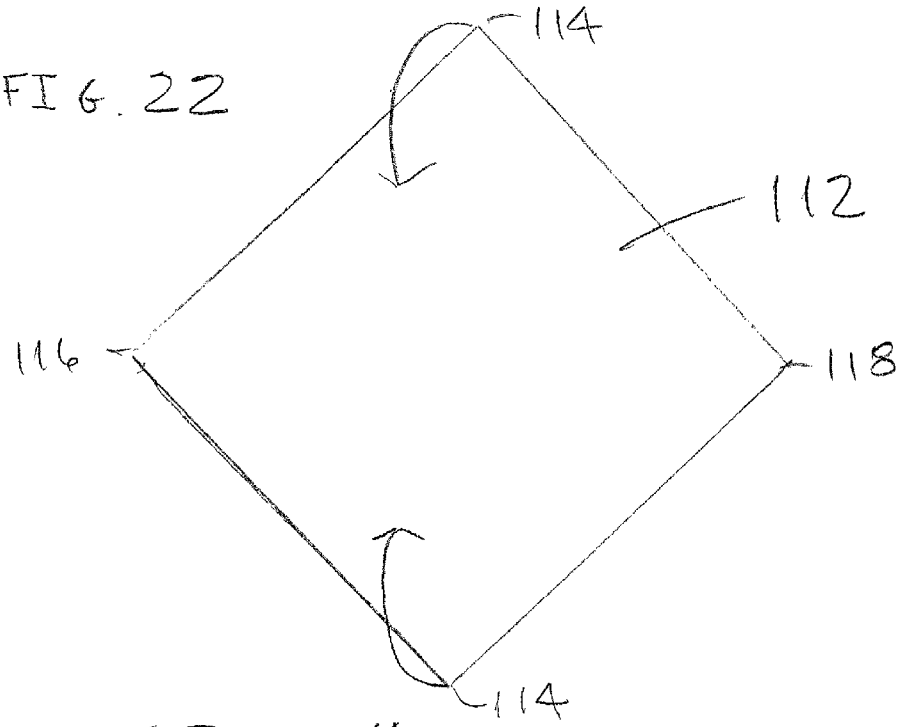
FIG. 22 shows a piece of fabric material used to form an embodiment of the accessory-retaining neck scarf.
Figure 23:
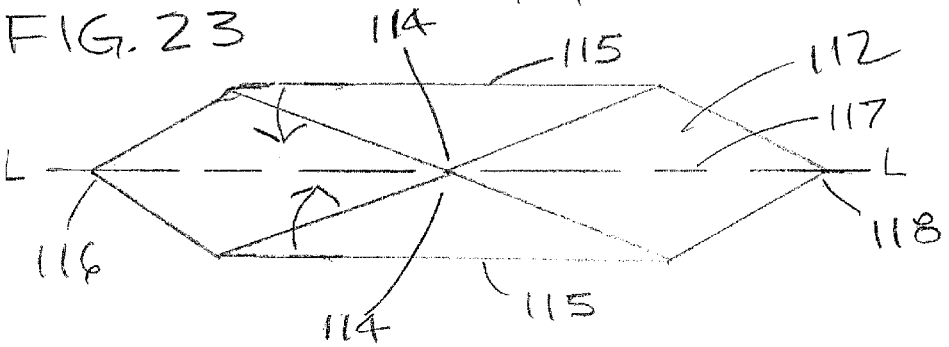
FIG. 23 shows the first folds that are made in the fabric material of FIG. 22 to form an embodiment of the accessory-retaining neck scarf.
Figure 24:
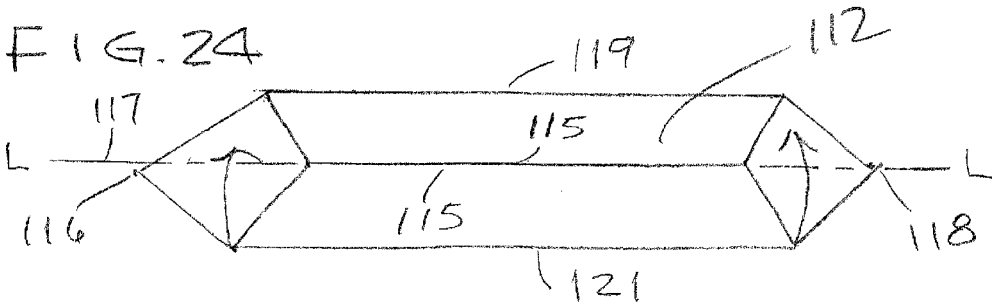
FIG. 24 shows the second folds that are made in the fabric material of FIG. 22 to form an embodiment of the accessory-retaining neck scarf.
Figure 25:
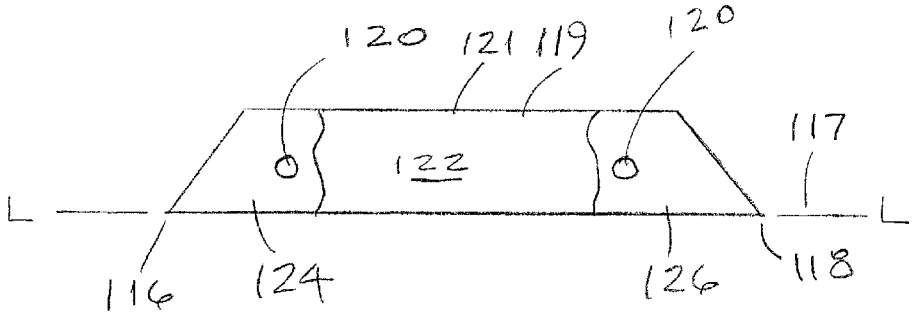
FIG. 25 shows the third fold that is made in the fabric material of FIG. 22 to form an embodiment of the accessory-retaining neck scarf.
Figure 26:
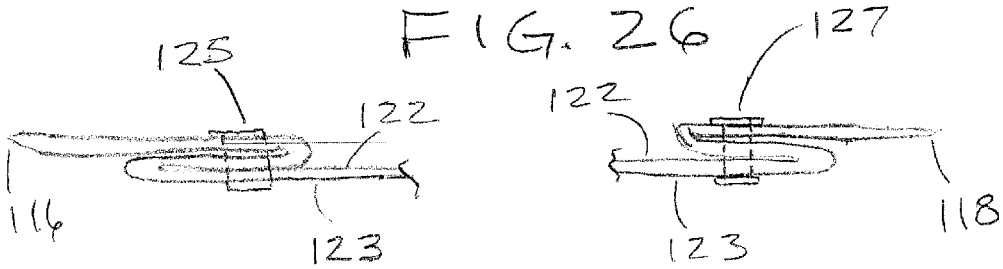
FIG. 26 shows side views of the pleated left and right ends of the accessory-retaining neck scarf in FIG. 25.
Figure 27:
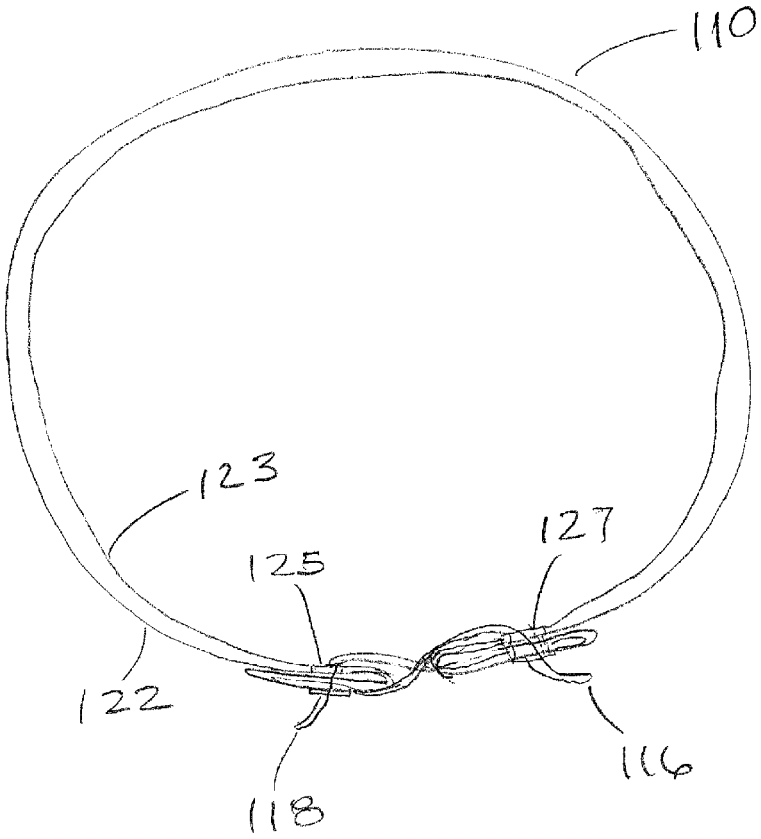
FIG. 27 shows the configuration of the accessory-retaining neck scarf in FIG. 25 when secured around the upper body of a wearer.

FIGS. 22 to 26 illustrate a further embodiment, in which a scarf 110 is formed from a piece of fabric material 112. The scarf 110 is securable to a wearer without the need to tie the fabric 112. As shown in FIG. 22, the fabric material 112 has a generally square shape and two opposed corners 114 that are folded inwardly toward each other so that the corners 114 meet at approximately the center of the fabric material 112 as shown in FIG. 23. The opposed longitudinal edges 115 are folded inwardly so that they are disposed next to each other along the central longitudinal axis (L-L) 117 as shown in FIG. 24. The opposing side edges 119, 121 of the fabric material 112 are then folded over along the central longitudinal axis L-L as shown in FIG. 25.

The ends are then folded over the top surface 122 of the scarf material 112 to form a pleat 124, 126 at each end 116, 118 and apertures 120 extending through each of the pleats 124, 126 are formed. Grommets 125, 127 are inserted through the apertures 120 in each of the pleats 124, 126 to maintain the pleats 124, 126 and form the scarf 110. The grommets 125, 127 form a passage or through hole extending from the top surface 122 to the back surface 123 of the scarf 110. Two opposed corners of the material form the first and second ends 116, 118 of the scarf 110.

In order to secure the scarf 110 to the wearer, the scarf 110 is wrapped around the wearer with the top surface 122 facing out. The first end 116 is crossed over the second end 118 of the scarf 110 and inserted in the through hole of the grommet 125 on the second end 118. The first end 116 is inserted in the through hole from the back surface 123 to the front surface 122. The second end 118 may then be inserted in the through hole of the grommet 127 adjacent the first end 116. The second end 118 passes through the through hole in the grommet 127 from the back surface 123 to the front surface 122. When both ends 116, 118 are inserted in the through holes of the grommets 125, 127, the material bunches forming an aesthetically pleasing flower-like design. This is achieved without tying the fabric. The scarf 110 can be easily secured to the wearer and also easily removed.

Figure 28:
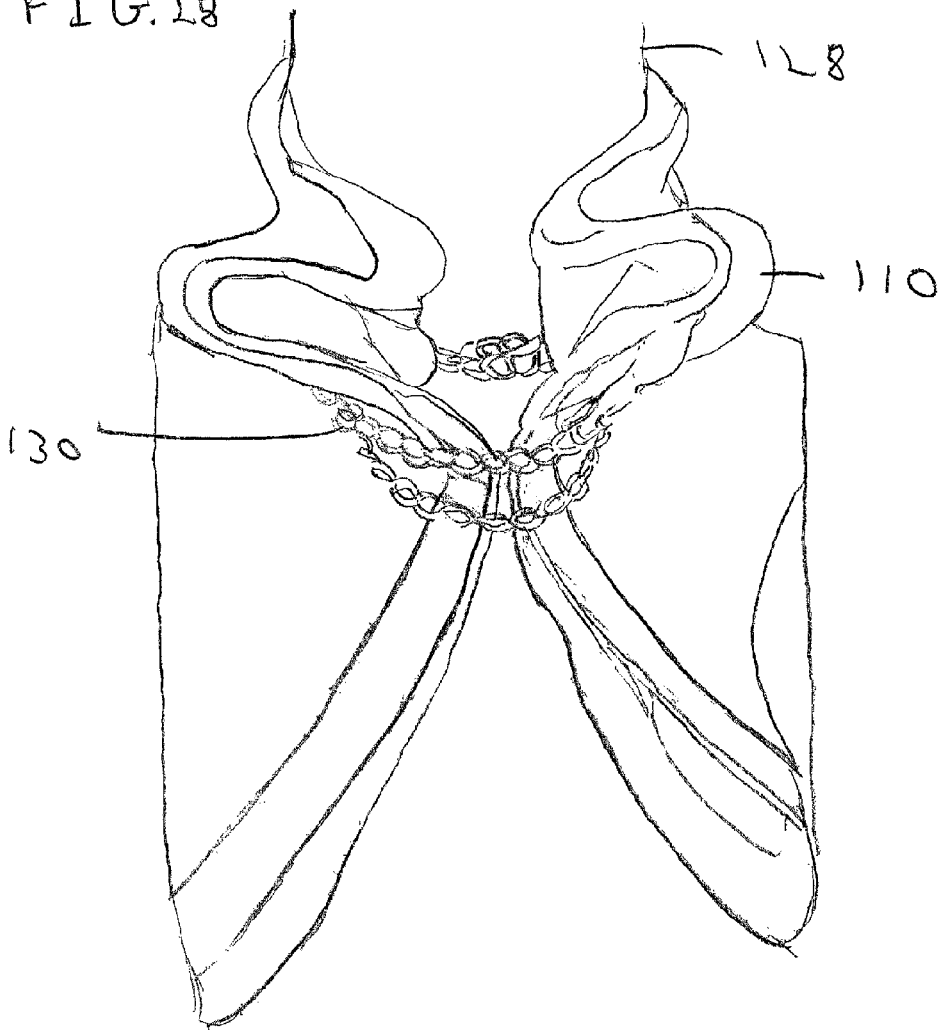
FIG. 28 shows a front view of an alternative embodiment of the neck scarf of FIG. 27 being secured with an accessory strand.
Figure 29:
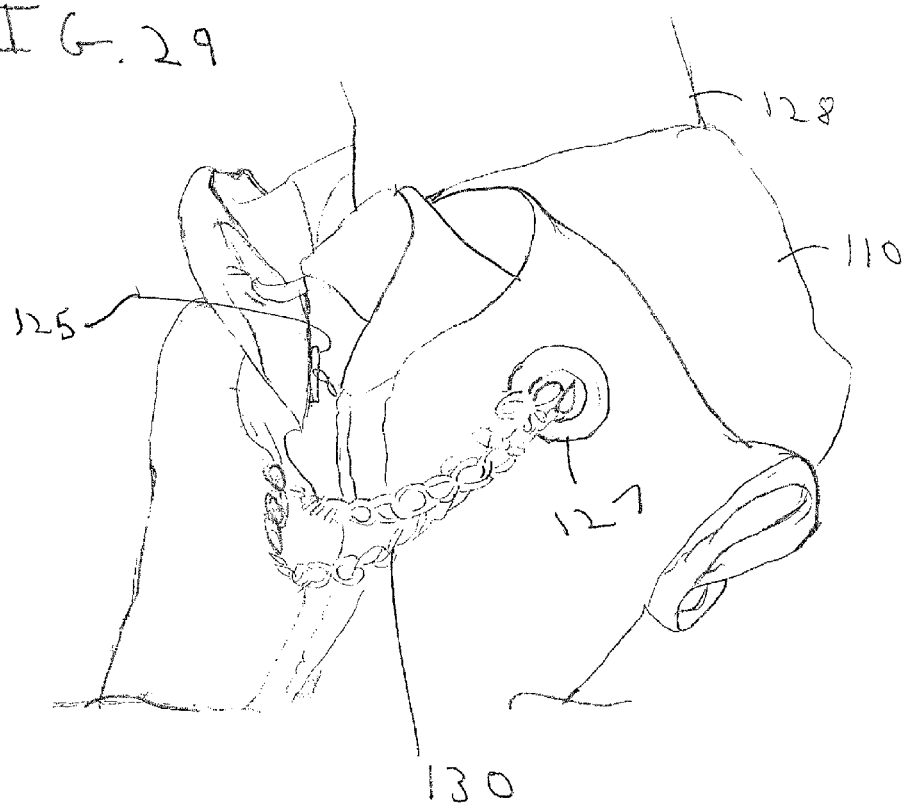
FIG. 29 shows a side view of the neck scarf of FIG. 28.

With reference to FIGS. 28 and 29, the accessory-retaining neck scarf 110 may be secured by way of an accessory strand 130. The scarf 110 may be placed around a wearer's neck 128 and the strand 130 inserted through the grommets 125 and 127. The strand 130 can include a clasp, hook or other fastening device (not shown) to allow the strand 130 to be selectively secured to itself after it is inserted through the grommets 125, 127. The strand 130 helps to retain the scarf 110 and provides an aesthetically pleasing arrangement. A wearer can easily and repeatedly create this arrangement without the need to undertake complicated tying of the scarf 110. To remove the scarf 110, the wearer unclasps the strand 130 and removes it from the scarf 110. The scarf 110 can then be removed from the wearer's neck 128. Since the strand 130 is removable from the scarf 110, it is within the contemplation of the present invention that a wearer would use one of a variety of different strands 130 with the scarf 110 to create desired arrangements.

Although illustrative embodiments of the present disclosure have been described herein with reference to the accompanying drawings, it is to be understood that the invention is not limited to those precise embodiments and that various other changes and modifications may be effected herein by one skilled in the art without departing from the scope or spirit of the invention. Also, it will be appreciated that variations of the embodiments disclosed above and other features and functions, or alternatives thereof, may be desirably combined with various other pieces of apparel or adornment. It will further be appreciated that various presently unforeseen or unanticipated alternatives, modifications, variations, or improvements therein may be subsequently made by those skilled in the art which are also intended to be encompassed by the disclosed embodiments and the following claims.

I claim:

1. An accessory-retaining neck scarf comprising:

a scarf formed as an elongate web for wrapping around a wearer, wherein the scarf has a length between first and second ends and a width between first and second sides;

a plurality of reinforced apertures, each aperture forming an opening from one exterior surface of the scarf to an opposing exterior surface, the plurality of apertures disposed along a lengthwise extent of the scarf; and an accessory strand extending along at least a portion of the lengthwise extent and weaving continuously through one or more of the plurality of apertures, wherein one end of the scarf is folded along the width to form two mutually engaging folds, wherein the apertures form openings that extend through the mutually engaging folds of the scarf.

2. The accessory-retaining neck scarf of claim 1, wherein the accessory strand is formed by a chain, a rope, a belt, a ribbon, a sash, a scarf, a belt or a decorative strand adorned with jewelry.

3. The accessory-retaining neck scarf of claim 1, wherein each of the plurality of apertures is reinforced by a grommet, an eyelet, a rivet or a material more rigid than that of the scarf.

4. The accessory-retaining neck scarf of claim 1, wherein the accessory strand includes an ornamental feature extending away from a lengthwise center of the scarf in a widthwise direction.

5. The accessory-retaining neck scarf of claim 1, wherein at least one of two opposed ends of the accessory strand includes a fastener for securing the at least one of two opposed ends to another portion of the accessory strand.

6. An accessory-retaining neck scarf comprising:

a scarf formed as an elongate web for wrapping around a wearer, wherein the scarf has a length between first and second ends and a width between first and second sides;

a plurality of reinforced apertures, each aperture forming an opening from one exterior surface of the scarf to an opposing exterior surface, the plurality of apertures disposed along a lengthwise extent of the scarf; and an accessory strand extending along at least a portion of the lengthwise extent and weaving continuously through one or more of the plurality of apertures, wherein the scarf has a first fold and a second fold along the lengthwise extent so that the sides of the scarf are disposed adjacent to each other, wherein the first and second folds have first and second top sides disposed opposite first and second back sides, respectively, and wherein the first top side is disposed adjacent to the second top side and the first and second back sides of the folds form exterior surfaces of the scarf.

7. The accessory-retaining neck scarf of claim 6, wherein the accessory strand is formed by a chain, a rope, a belt, a ribbon, a sash, a scarf, a belt or a decorative strand adorned with jewelry.

8. The accessory-retaining neck scarf of claim 6, wherein at least one of two opposed ends of the accessory strand includes a fastener for securing the at least one of two opposed ends to another portion of the accessory strand.

9. The accessory-retaining neck scarf of claim 6, wherein each of the plurality of apertures is reinforced by a grommet, an eyelet, a rivet or a material more rigid than that of the scarf.

* * * * *